US006170127B1

(12) United States Patent
Lim

(10) Patent No.: US 6,170,127 B1
(45) Date of Patent: Jan. 9, 2001

(54) ORNAMENT HANGER RING OF NECKLACE

(76) Inventor: Kon-hwan Lim, 39 Hongik-dong, Seongdong-gu, Seoul (KR)

( * ) Notice: Under 35 U.S.C. 154(b), the term of this patent shall be extended for 0 days.

(21) Appl. No.: 09/370,333

(22) Filed: Aug. 6, 1999

(51) Int. Cl.[7] ..... A44B 21/00; A44C 5/00

(52) U.S. Cl. ..... 24/3.4; 24/3.13; 24/116 A; 24/299; 63/4

(58) Field of Search ..... 24/3.4, 3.1, 3.13, 24/3.3, 3.9, 116 A, 299, 573.1; 63/4; 362/104

(56) References Cited

U.S. PATENT DOCUMENTS

| | | | | |
|---|---|---|---|---|
| 0,444,673 | * | 1/1891 | Roehr | 63/4 |
| 2,296,084 | * | 9/1942 | Bloom et al. | 24/3.13 |
| 2,947,456 | * | 8/1960 | Seron | 24/3.4 |
| 3,094,754 | * | 6/1963 | Wayne | 24/116 A |
| 4,930,052 | * | 5/1990 | Beige | 362/104 |
| 5,465,466 | * | 11/1995 | Napier | 24/3.11 |
| 5,893,198 | * | 4/1999 | DeCotis | 24/3.13 |

* cited by examiner

*Primary Examiner*—Victor N. Sakran
(74) *Attorney, Agent, or Firm*—Darby & Darby

(57) ABSTRACT

Disclosed is a hanger ring connected to an ornament for hanging the ornament on a necklace string. The hanger ring comprises a lower member having a body of a ∪-shaped configuration, which has a first pin hole and a depression and possesses an eye portion secured to a lower end of the body for hooking the ornament, a release preventing projection extending upward from one side of an upper end of the body, and an ornamental knob portion defined at the other side of the upper end of the body; an upper member having a pair of side plates of a semi-elliptical configuration, which are formed with a pair of second pin holes, respectively, and define an inserting space therebetween for allowing the body of the lower member to be inserted into the inserting space, and a curved engaging portion of a ∩-shaped configuration, which has a free end brought into contact with a free end of the release preventing projection; a pin inserted through the first pin hole and the pair of second pin holes for rotatably coupling the upper member to the body of the lower member; and an elastic member received into the depression of the lower member for exerting elastic force to the upper member such that the upper member is returned to its original position.

1 Claim, 3 Drawing Sheets

ORNAMENT HANGER RING OF NECKLACE

BACKGROUND OF THE INVENTION

1. Field of the Invention

The present invention relates to an ornament hanging ring for a necklace, and more particularly, the present invention relates to an ornament hanging ring for a necklace, which is connected to an ornament to hang the ornament on a necklace string and is structured such that it can be directly attached to and detached from the necklace string.

2. Description of the Related Art

Generally, the neck of the human body may be ornamented with a necklace which is hung around it, for the purpose of making clothes look better and achieving a certain aesthetic feeling. Such a necklace 10 comprises, as shown in FIG. 1, a necklace string 12 which has a predetermined length to be hung around the neck of the human body. Both ends of the necklace string 12 are formed with a pair of connecting members (not shown), respectively, which selectively connect or disconnect the ends of the necklace string 12. The necklace 10 may include an ornament 14 such as a diamond, a pearl, etc. which is hung on the necklace string 12 as occasion demands, and a hanger ring 16 which is coupled to an upper end of the ornament 14 to enable the ornament 14 to be easily hung on the necklace string 12.

Further, while it is possible for the hanger ring 16 used for hanging the ornament 14 on the necklace string 12 to be integrally coupled to the ornament 14, it is the norm in most cases that, as shown in FIG. 1, a separate ring 14*a* is provided at the upper end of the ornament 14 to be hooked on the hanger ring 16.

When it is required to hang the ornament 14 on the necklace string 12 in a state wherein the ornament 14 is hooked on the hanger ring 16 via the separate ring 14*a*, one end of the necklace string 12 is passed through the hanger ring 16, the ornament 14 is moved to be positioned at a substantially middle portion of the necklace string 12, and the pair of connecting members formed at both ends of the necklace string 12 are connected with each other after the necklace string 12 is placed around the neck of the human body, whereby wearing of the necklace 10 is completed.

However, the necklace 10 of the conventional art, in which the ornament 14 is hung on the necklace string 12 by the hanger ring 16, suffers from defects in that since the necklace string 12 cannot be passed through the hanger ring 16 when a plurality of jewels such as pearls are threaded on the necklace string 12, the ornament 14 cannot be hung on the necklace string 12, and since one end of the necklace string 12 must be passed through the hanger ring 16 and the hanger ring 16 must be moved in its position even when the ornament 14 can be hung on the necklace string 12, inconvenience is caused. Specifically, in the case that the necklace string 12 is worn around the neck of the human body, because the necklace string 12 can be placed around the neck of the human body and the pair of connecting members can be connected with each other only after the pair of connecting members of the necklace string 12 are disconnected from each other and the ornament 14 is threaded on the necklace string 12 via the hanger ring 16, a great deal of effort and time is required.

SUMMARY OF THE INVENTION

Accordingly, the present invention has been made in an effort to solve the problems occurring in the related art, and an object of the present invention is to provide an ornament hanging ring for a necklace, which is structured such that it can be directly attached to and detached from a necklace string, whereby an ornament can be hung on the necklace string irrespective of a shape and a kind of the necklace string and an ornament replacement operation can be conveniently performed in a short time while the necklace string is worn around the neck of the human body.

In order to achieve the above object, according to one aspect of the present invention, there is provided a hanger ring connected to an ornament for hanging the ornament on a necklace string, the hanger ring comprising: a lower member having a body of a substantially ∪-shaped configuration, which is formed at an upper part with a curved portion, at a middle part with a first pin hole, and at one surface with an elastic member receiving depression, the body possessing an eye portion secured to a lower end of the body for hooking the ornament, a release preventing projection extending upward from one side of an upper end of the body, and an ornamental knob portion defined at the other side of the upper end of the body such that it is opposed to the release preventing projection, the ornamental knob portion having preselected width and contour for allowing ornaments to be attached thereto or formed thereon and extending upward by a predetermined length from the other side of the upper end for enabling a finger to come into contact therewith; an upper member having a pair of side plates of a semi-elliptical configuration, which are formed with a pair of second pin holes, respectively, and define an inserting space therebetween for allowing the body of the lower member to be inserted into the inserting space such that the upper member is rotatably coupled to the body of the lower member, and a curved engaging portion of a substantially ∩-shaped configuration, which is integrally formed with upper ends of the pair of side plates and has a free end brought into contact with a free end of the release preventing projection; a pin inserted through the first pin hole and the pair of second pin holes for rotatably coupling the upper member to the body of the lower member; and an elastic member received into the elastic member receiving depression of the lower member for exerting elastic force to the upper member such that the upper member is returned to its original position when rotated outward about the pin, the elastic member having one end fastened to the upper member and the other end fastened to the lower member.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
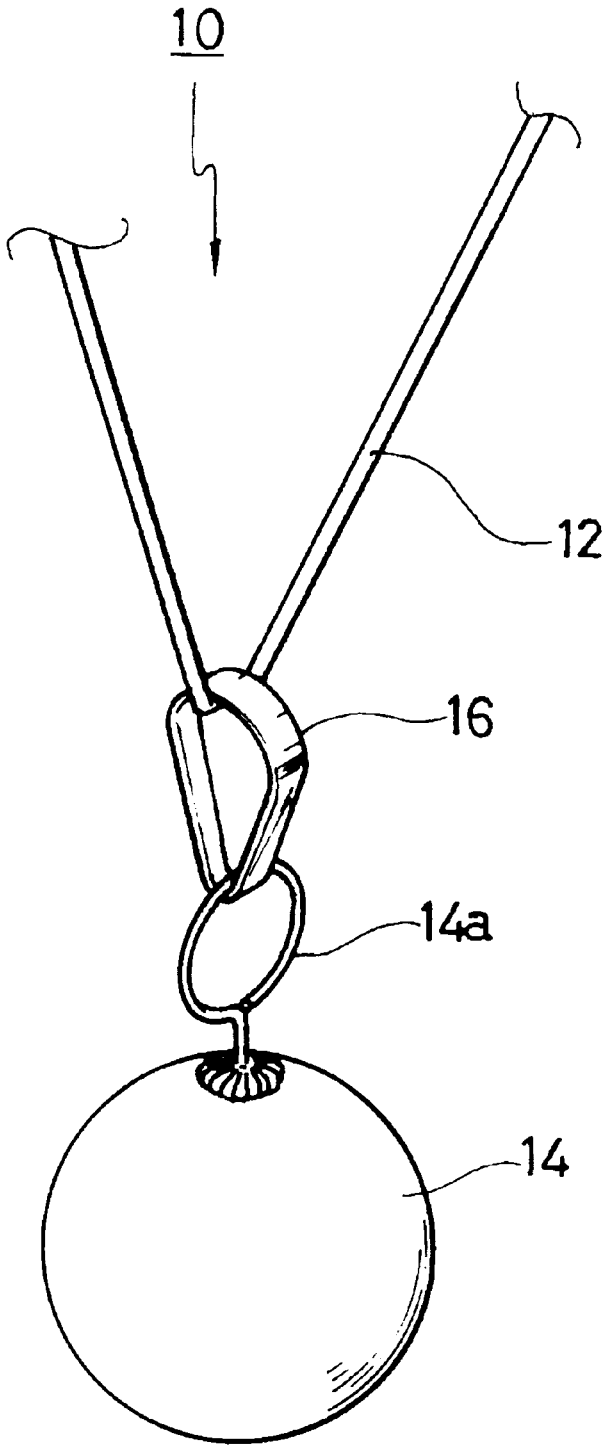
FIG. 1 is a perspective view illustrating an ornament hanging ring for a necklace of the conventional art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
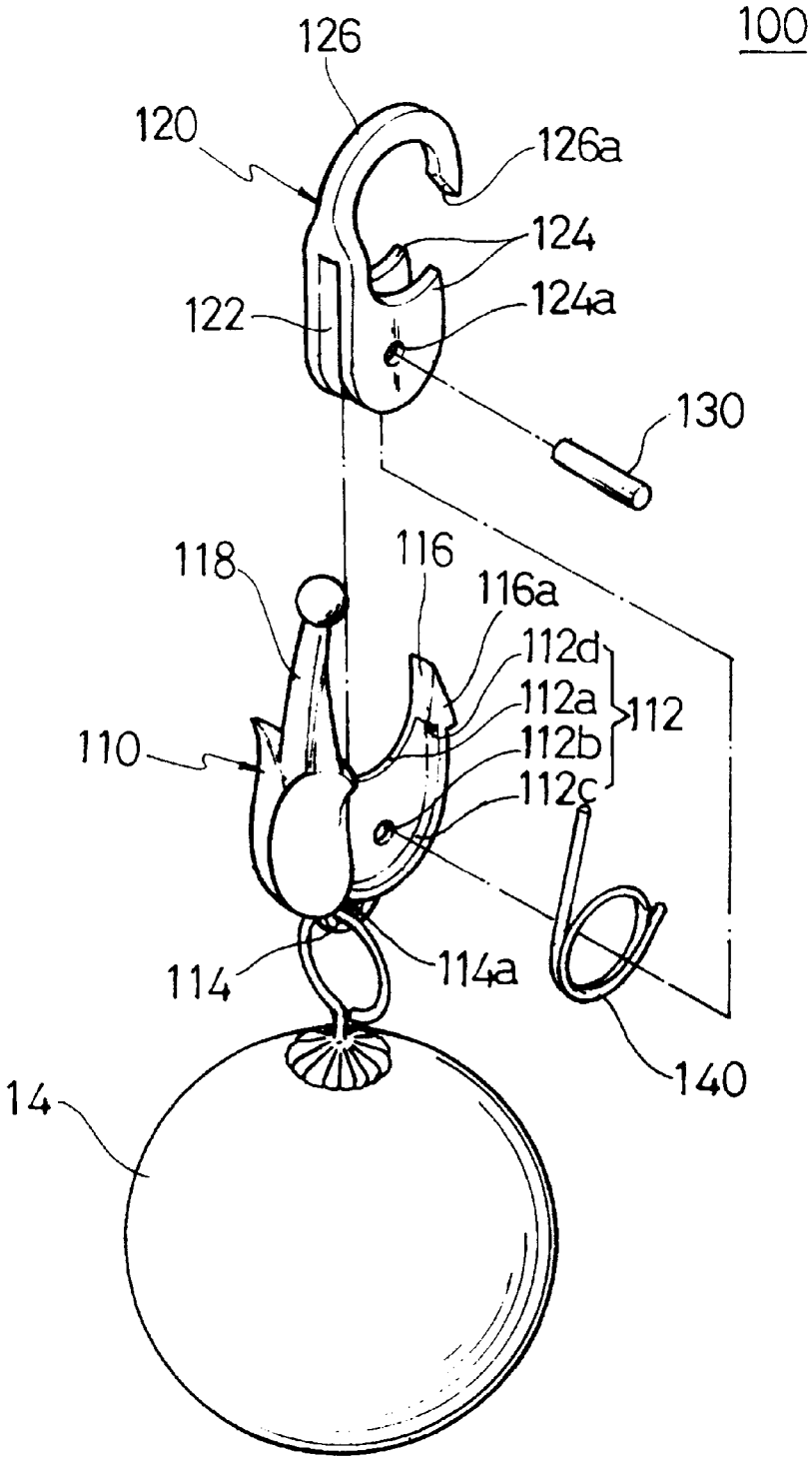
FIG. 2 is an exploded perspective view illustrating an ornament hanging ring for a necklace in accordance with an embodiment of the present invention.
Figure 3:
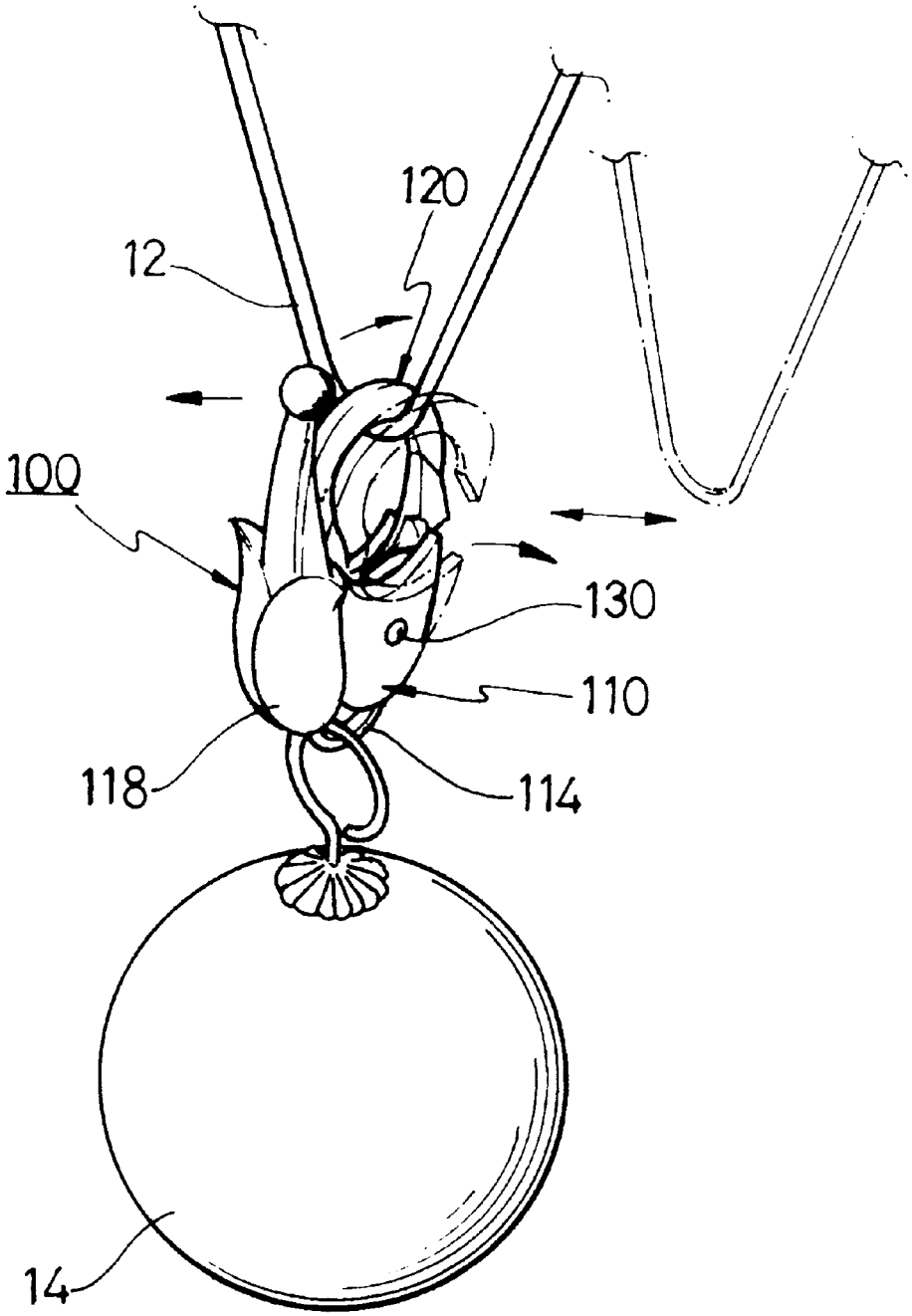
FIG. 3 is a perspective view illustrating a state wherein the ornament hanging ring for the necklace according to the present invention is used.

FIG. 2 is an exploded perspective view illustrating an ornament hanging ring for a necklace in accordance with an embodiment of the present invention; and FIG. 3 is a perspective view illustrating a state wherein the ornament hanging ring for the necklace according to the present invention is used.

As shown in FIGS. 1 and 2, an ornament hanging ring 100 of the present invention is connected to an ornament 14 for hanging the ornament 14 on a necklace string 12. The ornament hanging ring 100 includes a lower member 110 which is coupled to the ornament 14 and is directly attached to and detached from the necklace string 12, an upper member 120 which is rotatably coupled downward to the lower member 110, a pin 130 for coupling the upper member 120 to the lower member 110, and an elastic member 140 which is disposed to exert elastic force to the upper member 120 such that the upper member 120 is returned to its original position when rotated outward about the pin 130.

The lower member 110 has a body 112 of a substantially ∪-shaped configuration. The body 112 of the lower member 110 is formed at an upper part thereof with a curved portion 112*a*, at a middle part thereof with a first pin hole 112*b*, and at one surface thereof with an elastic member receiving depression 112*c*. The body 112 possesses an eye portion 114 which is secured to a lower end of the body 112 for hooking the ornament 14, a release preventing projection 116 which extends upward from one side of an upper end of the body 112, and an ornamental knob portion 118 which is defined at the other side of the upper end of the body 112 such that it is opposed to the release preventing projection 116. The ornamental knob portion 118 has preselected width and contour for allowing ornaments to be attached thereto or formed thereon and extends upward by a predetermined length from the other side of the upper end of the body 112 for enabling a finger to come into contact therewith.

The upper member 120 has a pair of side plates 124 of a semi-elliptical configuration. The pair of side plates 124 are formed with a pair of second pin holes 124*a*, respectively, and define an inserting space 122 therebetween for allowing the body 112 of the lower member 110 to be inserted into the inserting space 122 such that the upper member 120 is rotatably coupled to the body 112 of the lower member 110. The upper member 120 further has a curved engaging portion 126 of a substantially ∩-shaped configuration. The curved engaging portion 126 is integrally formed with upper ends of the pair of side plates 124 and has a free end which is brought into contact with a free end of the release preventing projection 116.

The pin 130 is inserted through the pair of second pin holes 124*a* of the upper member 120 and the first pin hole 112*b* of the lower member 110.

The elastic member 140 is received in the elastic member receiving depression 112*c* of the lower member 110.

On the other hand, when describing the construction of the lower member 110 in more detail, the eye portion 114 has one end which is secured to the lower end of the body 112 and the other end which is secured to a lower end of the ornamental knob portion 118, thereby to define an opening 114*a* of a preselected shape. One end of the elastic member receiving depression 112*c* which is adjacent to the release preventing projection 116, is formed with a fitting groove 112*d* into which one end of the elastic member 140 is inserted to be fastened therein. An upper end of the release preventing projection 116 is formed with an inclined surface 116*a* which is sloped downward and outward. A width, a height and a contour of the ornamental knob portion 118 are not limited to those which are specifically determined. Instead, the ornamental knob portion 118 is formed such that the upper member 120 rotatably coupled downward to the lower member 110 and positioned behind the lower member 110 is not seen from the front, in a state wherein the ornament hanging ring 100 including the ornament 14 is attached to the necklace string 12, thereby to achieve a certain aesthetic feeling. The ornamental knob portion 118 can be modified in its contour, provided a finger can be easily inserted between the lower member 110 and the upper member 120 at front parts thereof to rotate the upper member 120 about the pin 130. For example, the ornamental knob portion 118 can be modified in its contour in that a coupling structure for coupling separate auxiliary ornaments is attached to a front surface thereof.

In the above construction of the present invention, the free end of the curved engaging portion 126 of the upper member 120 is formed with an inclined surface 126*a* which is brought into surface contact with the inclined surface 116*a* of the release preventing projection 116 of the lower member 110. The inclined surface 126*a* of the curved engaging portion 126 and the inclined surface 116*a* of the release preventing projection 116 are engaged with and disengaged from each other as the upper member 120 is rotated.

In the above construction of the present invention, the elastic member 140 comprises a torsion spring which has one end fitted into the fitting groove 112*d* of the lower member 110 to be fastened therein and the other end fastened against an inner surface of the upper member 120 adjacent an upper end of the inserting space 122.

Hereinafter, operations of the ornament hanging ring 100 according to the present invention, constructed as mentioned above, will be described in detail.

As shown in FIG. 3, if the ornament hanging ring 100 according to the present invention, having the ornament 14 hooked thereon is attached to the necklace string 12, as the ornamental knob portion 118 of the lower member 110 is pulled by a finger or a finger is inserted downward between the ornamental knob portion 118 of the lower member 110 and the curved engaging portion 126 of the upper member 120, the lower member 110 is rotated in a counterclockwise direction about the pin 130 and the upper member 120 is rotated in a clockwise direction about the pin 130, and the inclined surface 126*a* of the curved engaging portion 126 and the inclined surface 116*a* of the release preventing projection 116 which are in contact with each other are disengaged from each other, whereby an inner space which is maintained in a closed state is opened.

In this situation, the necklace string 12 is inserted into the inner space through a gap which is defined between a lower end of the curved engaging portion 126 and the upper end of the release preventing projection 116. Then, by removing the finger which is inserted between the ornamental knob portion 118 of the lower member 110 and the curved engaging portion 126 of the upper member 120, the upper member 120 is returned to its original position by elastic force of the embedded elastic member 140 and then, the inclined surface 126*a* of the curved engaging portion 126 and the inclined surface 116*a* of the release preventing projection 116 come into contact with each other, whereby the inner space which is maintained in an opened state is closed and the necklace string 12 is prevented from being released from the inner space.

In other words, in this way just described above, the ornament hanging ring 100 including the ornament 14 is mounted to the necklace string 12 without being released.

On the contrary, if it is required to replace the ornament 14 with a new one for harmonizing the necklace with clothes or for creating a new fashion as clothes put on by a wearer are changed, a finger is inserted again downward between the ornamental knob portion 118 of the lower member 110 and the curved engaging portion 126 of the upper member 120, thereby to disengage the curved engaging portion 126 and the release preventing portion 116 from each other, and then, by taking out the necklace string 12 from the ornament hanging ring 100, a removing operation of the ornament 14 is completed.

In this state, since it is only required that the ornament hanging ring 100 on which a new ornament 14 is hooked, is attached again to the necklace string 12 in the way as described above, to create an expected fashion, due to the fact that it is not necessary to untie the necklace string 12 and thread the ornament hanging ring 100 on the necklace string 12 for replacing the ornament 14 of the necklace 100 with the new one, an ornament replacement operation can be conveniently performed in a short time.

As described above, by the ornament hanging ring for a necklace according to the present invention, advantages are provided in that since the ornament hanging ring coupled to an ornament is not threaded on and from one end of a necklace string, but hung on the necklace string regardless of a position along the necklace string, mounting of the ornament can be conveniently implemented in a short time, the ornament can be hung on the necklace string irrespective of a shape and a kind of the necklace string, and especially, the ornament can be easily attached to and detached from the necklace string while the necklace string is worn around the neck of the human body.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A hanger ring connected to an ornament for hanging the ornament on a necklace string, the hanger ring comprising:

a lower member having a body of a substantially ∪-shaped configuration, which is formed at an upper part with a curved portion, at a middle part with a first pin hole, and at one surface with an elastic member receiving depression, the body possessing an eye portion secured to a lower end of the body for hooking the ornament, a release preventing projection extending upward from one side of an upper end of the body, and an ornamental knob portion defined at the other side of the upper end of the body such that it is opposed to the release preventing projection, the ornamental knob portion having preselected width and contour for allowing ornaments to be attached thereto or formed thereon and extending upward by a predetermined length from the other side of the upper end for enabling a finger to come into contact therewith;

an upper member having a pair of side plates of a semi-elliptical configuration, which are formed with a pair of second pin holes, respectively, and define an inserting space therebetween for allowing the body of the lower member to be inserted into the inserting space such that the upper member is rotatably coupled to the body of the lower member, and a curved engaging portion of a substantially ∩-shaped configuration, which is integrally formed with upper ends of the pair of side plates and has a free end brought into contact with a free end of the release preventing projection;

a pin inserted through the first pin hole and the pair of second pin holes for rotatably coupling the upper member to the body of the lower member; and an elastic member received into the elastic member receiving depression of the lower member for exerting elastic force to the upper member such that the upper member is returned to its original position when rotated outward about the pin, the elastic member having one end fastened to the upper member and the other end fastened to the lower member.

* * * * *